US006323407B1

(12) United States Patent
May

(10) Patent No.: US 6,323,407 B1
(45) Date of Patent: Nov. 27, 2001

(54) CARRIER ASSEMBLY FOR PERCUSSION INSTRUMENTS

(76) Inventor: Randall L. May, 8 Windsor, Newport Beach, CA (US) 92660

( * ) Notice: Subject to any disclaimer, the term of this patent is extended or adjusted under 35 U.S.C. 154(b) by 0 days.

(21) Appl. No.: 09/497,265

(22) Filed: Feb. 3, 2000

Related U.S. Application Data

(63) Continuation-in-part of application No. 08/976,999, filed on Nov. 24, 1997, now Pat. No. 6,028,257, and a continuation-in-part of application No. 08/588,244, filed on Jan. 18, 1996, now Pat. No. 5,691,492.

(51) Int. Cl.[7] ..... G10D 13/02
(52) U.S. Cl. ..... 84/421; 248/443; 248/444
(58) Field of Search ..... 84/411 R, 421; 248/443, 444

(56) References Cited

U.S. PATENT DOCUMENTS 4,256,007 * 3/1981 Streit ..... 84/421
4,387,839 * 6/1983 Dranchak ..... 84/421
4,402,441 * 9/1983 Jones et al. ..... 84/421
4,453,442 * 6/1984 LaFlame ..... 84/421
4,605,144 * 8/1986 LaFlame ..... 84/421
4,634,032 * 1/1987 LaFlame ..... 84/421
4,799,610 * 1/1989 Hsieh ..... 84/421
5,400,683 * 3/1995 LaFlame ..... 84/421
5,573,158 * 11/1996 Penn ..... 84/421
5,973,247 * 10/1999 Matthews ..... 84/421

* cited by examiner

*Primary Examiner*—Robert E. Nappi
*Assistant Examiner*—Marlon Fletcher

(57) ABSTRACT

Drum hardware and drum secured thereon are preferably supported on a vest type carrier or a T-bar carrier having a plurality of separate parts removable from each other and formed of a rigid light material such as plastic or a light metal such as magnesium, aluminum or titanium. The carrier has a vest or belly plate, shoulder straps, and back bar and the shoulder straps are removable and/or adjustable. The supporting elements are of rod or tubular construction. Special padding may be included on the shoulder straps, belly plate portion and other parts where cushioning is needed. The hardware may be universally adjustable.

18 Claims, 12 Drawing Sheets

CARRIER ASSEMBLY FOR PERCUSSION INSTRUMENTS

CROSS REFERENCE TO RELATED APPLICATION

This application is a continuation-in-part of applicant's applications Ser. No. 08/588,244 filed Jan. 18, 1996 now U.S. Pat. No. 5,691,492, issued Nov. 25, 1997 and Ser. No. 08/976,999 filed Nov. 24, 1997 now U.S. Pat. No. 6,028, 257, issued Feb. 22, 2000.

BACKGROUND OF THE INVENTION

1. Field of the Invention

This invention relates to new and useful improvements in apparatus for carrying percussion instruments, particularly drums of various kinds. Further, the present invention relates to a carrier hardware including a novel support for percussion instruments and to carrier assemblies supporting percussion instruments on a person while standing, walking or marching. The carrier assembly has an adjustable construction and relationship of parts to transfer the weight of the percussion instrument(s) to the body of a person carrying the same to maintain a stable attitude while walking or marching about and avoid pressure or other forms of detrimental forces on the shoulders and lower back 2. Brief Description of the Prior Art The prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back-pressure plate and wrap about shoulders and support straps connect to the abdominal plate.

Hsieh U.S. Pat. No. 4,799,610 shows a carrier for percussion instruments having a "T" bar, a pair of shoulder bars, a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications.

La Flame U.S. Pat. No. 4,643,032 shows a carrier for various instruments such as marching bells, a marching xylophone or a marching marimba, which are supported on the apparatus by the use of suitably-constructed extension arms. The carrier frame is a U-shaped bent bar welded or otherwise attached to a belly plate and has extension arms which project from the belly plate to engage and support the instrument.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Dranchak U.S. Pat. No. 4,387,839 discloses a drum-supporting harness having two shoulder hooks with cushion pads or liners, a breast plate secured to the hooks, and a hanger structure attached to the breast plate and depending therefrom. Upwardly-facing hooks, a spacer bar extending downward from the hooks, and a spacing abutment carried by the spacer bar and extending forward therefrom are carried by the lower portion of the hanger structure. The hooks and the spacing abutment engage upper and lower portions of the body of the drum. The hanger structure is adjustable or extensible by means of overlapping strips which can be secured in a number of different positions. An adapter assembly attaches to the upper rim portion of the drum for connecting of hooks 16 to the drum.

Other possibly relevant prior art is Pyle U.S. Pat. No. 5,054,357; May U.S. Pat. No. 5,072,910 and May U.S. Pat. No. 5,300,810.

SUMMARY OF THE INVENTION

One object of the invention is to provide a new and improved carrier for percussion instruments comprising a novel T-bar carrier with belly plate, shoulder straps, and back bar in which the shoulder straps are removable and/or adjustable.

Another object of the invention is to provide a new and improved carrier for percussion instruments comprising a novel vest-type carrier with back bar and removable and/or adjustable shoulder straps.

Another object of the invention is to provide a new and improved carrier for percussion instruments having shoulder straps and an adjustable back bar.

Still another object of the invention is to provide a new and improved carrier for percussion instruments in which the supporting elements are of rod or tubular construction.

Other objects of the invention will become apparent throughout the specification and claims as hereinafter related.

DESCRIPTION OF THE PREFERRED EMBODIMENTS

Marching T-Bar Type Support for Drums and Other Percussion Instruments

Figure 1:
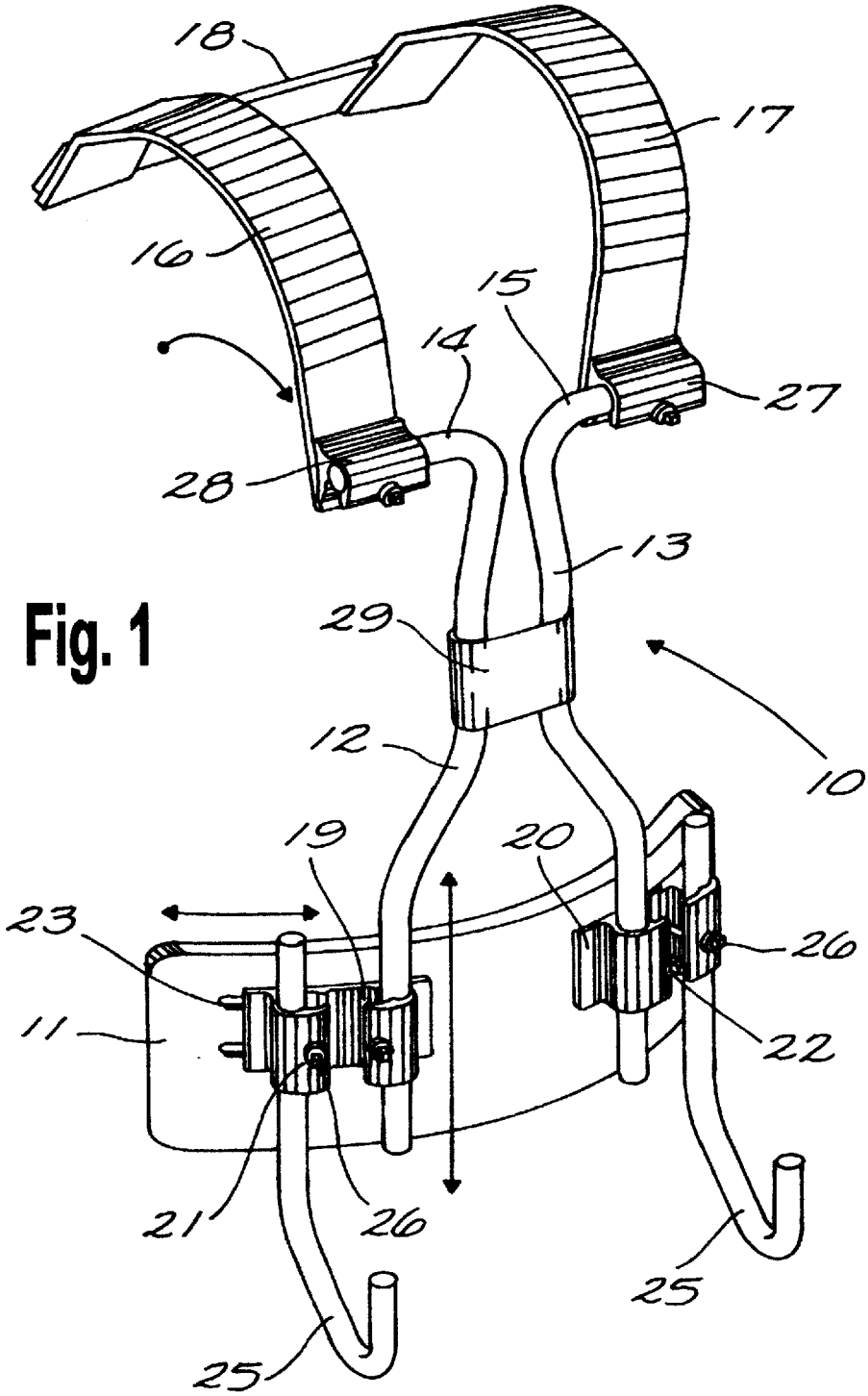
FIG. 1 is a front isometric view of hardware for supporting a drum in accordance with a preferred embodiment of the invention.
Figure 2:
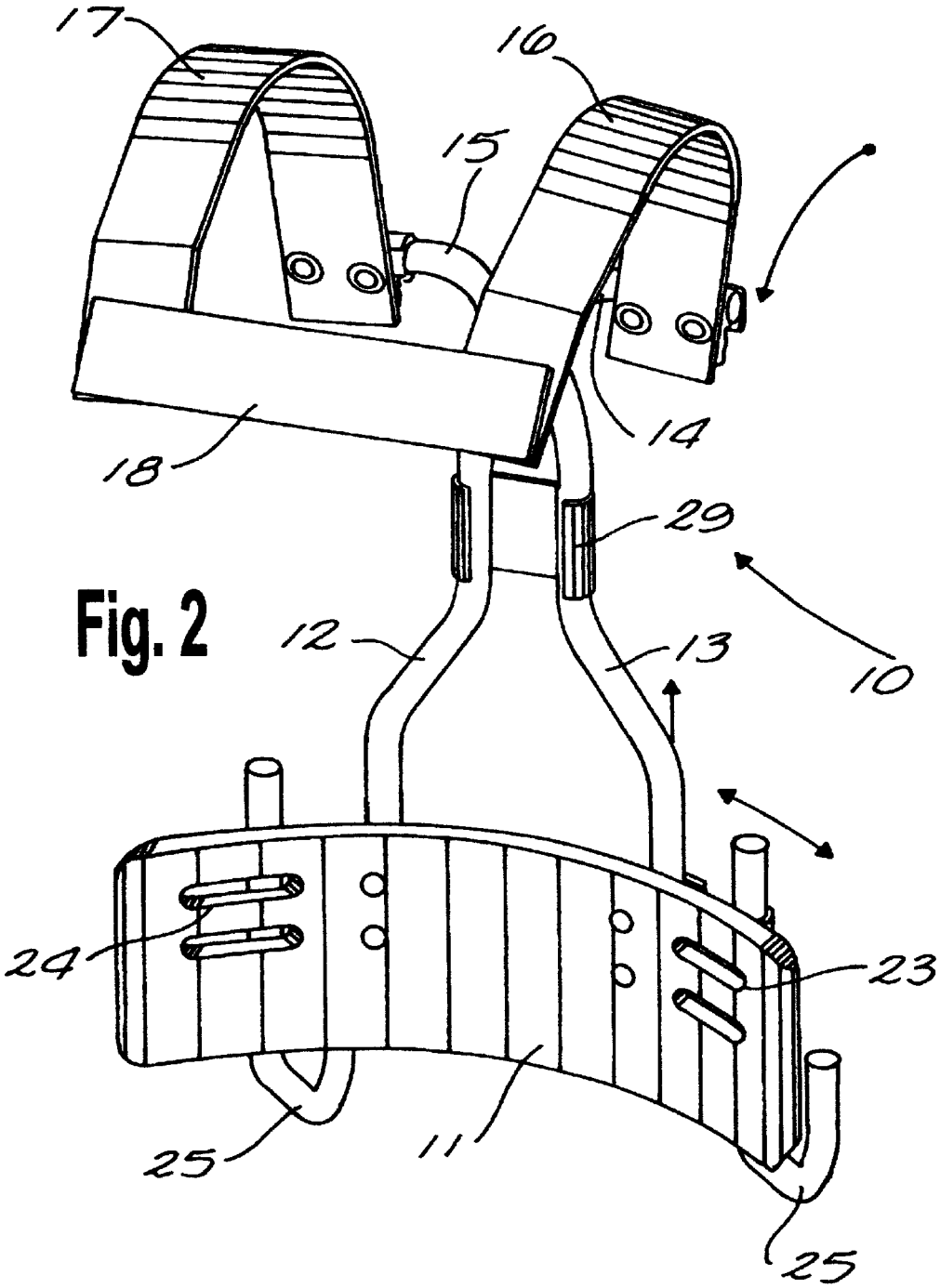
FIG. 2 is a rear isometric view of hardware for supporting a drum as shown in FIG. 1.

Referring to FIGS. 1 and 2, there is shown a T-bar-type carrier 10 for percussion instruments which comprises a belly plate 11, vertical supporting rods or tubes 12 and 13 having outturned portions 14 and 15 supporting rigid shoulder straps 16 and 17 and back bar 18. Back bar 18 may be removably secured to shoulder straps 18 or may be fixed as by welding or the like.

Belly plate 11 is removably secured on the lower ends of vertical rods or tubes 12 and 13 by clamping receptacles 19 and 20. J-rod receptacles 21 and 22 are secured on belly plate 11 in slots 23 and 24 by screws or bolts or the like. J-rods 25 are secured in receptacles 21 and 22 by bolts 26. The upper, out-turned ends 14 and 15 of supporting rods or tubes 12 and 13 are supported in clamping receptacles 27 and 28 on shoulder straps 16 and 17. A clamp 29 holds rods or tubes 12 and 13 against lateral displacement.

The materials of construction used in this carrier 10 are very important for achieving the desired result. The belly plate 11, vertical supporting rods or tubes 12 and 13, shoulder straps 16 and 17 and back bar 18 are rigid and made of a light material such as plastic or a light metal such as aluminum, magnesium or titanium. The metal shoulder straps have the advantage that different sizes are readily accommodated.

Operation

The operation of this carrier should be apparent but will be described briefly for clarity. The carrier 10 is worn by the musician with the shoulder straps 16 and 17 positioned over the shoulders and the belly plate 11 supported against the abdomen. J-rods 25 are inserted in position and secured in place by tightening bolts 26. The short outer ends of the J-rods 25 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 27 and 28 permit pivotal, lateral and angular adjustment of shoulder straps 16 and 17 on the out-turned ends 14 and 15 of rods or tubes 12 and 13. Clamp-receptacles 19 and 20 permit vertical sliding adjustment of rods or tubes 12 and 13. Slots 23 and 24 in belly plate 11 allow lateral adjustment of clamp-receptacles 21 and 22 and angular adjustment of J-rods supported therein.

Figures 3, 4:
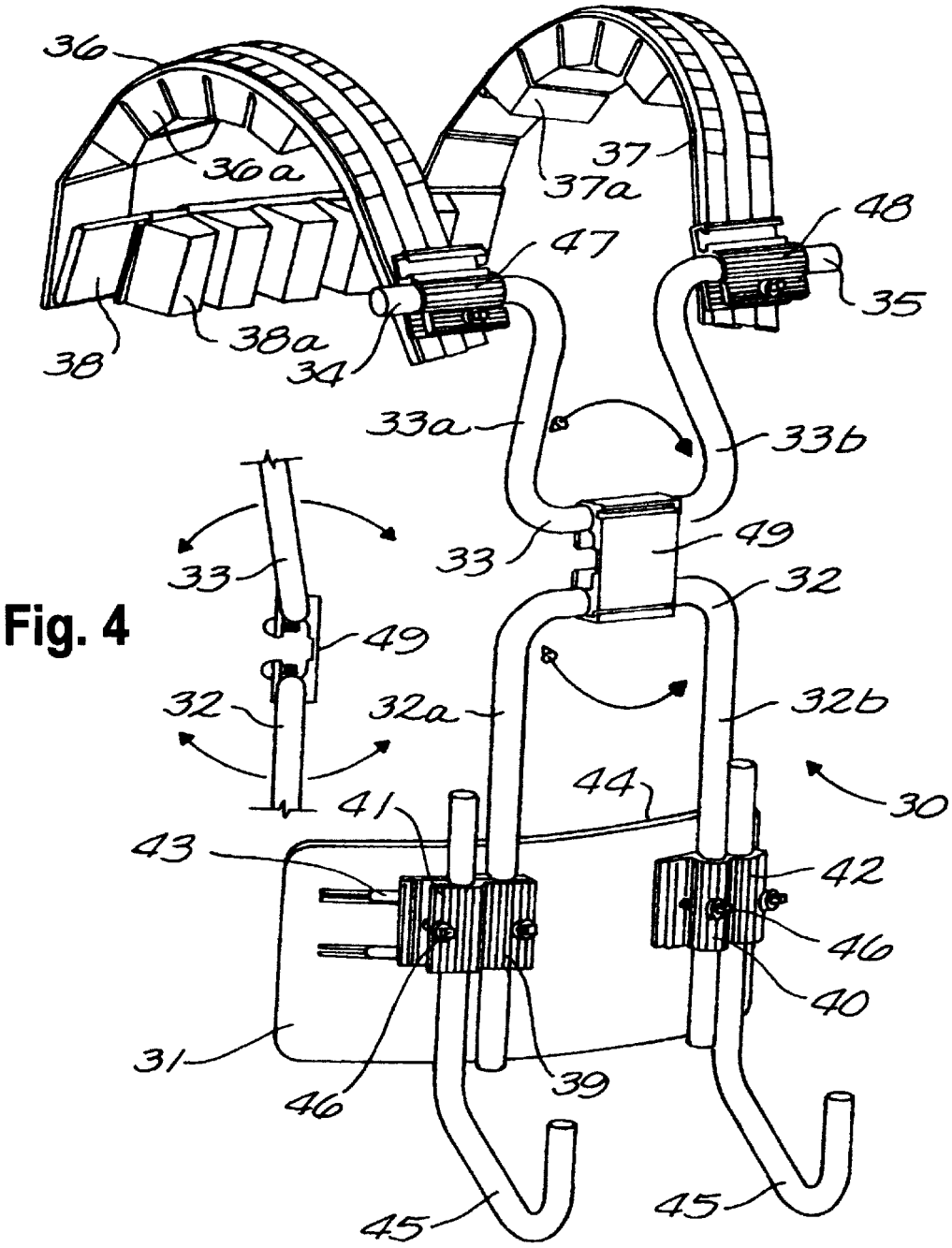
FIG. 3 is a front isometric view of hardware for supporting a drum and having vertical articulated supports in accordance with another embodiment of the invention.
FIG. 4 is a side view of the articulated joint in the hardware shown in FIG. 3.

An Articulated Embodiment of Marching T-Bar Type Support for Drums and Other Percussion Instruments Referring to FIG. 3, there is shown a T-bar-type carrier 30 for percussion instruments which comprises a belly plate 31, lower and upper vertical supporting rods or tubes 32 and 33. Lower rod or tube 32 is U-shaped with parallel portions 32*a* and 32*b* supporting belly plate 31. Upper rod or tube 33 is U-shaped with legs 33*a* and 33*b* having out-turned portions 34 and 35 supporting rigid shoulder straps 36 and 37 and back bar 38. Back bar 38 may be removably secured to shoulder straps 36 and 37 or may be fixed as by welding or the like. Shoulder straps 36 and 37 and back bar 38 have cushions 36*a*, 37*a* and 38*a*, respectively. The cushions are of a type used to pad the interior of football and other sports helmets and are shown in more detail in copending application Ser. No. 08/976,999. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

Belly plate 31 is removably secured on the lower ends 32*a* and 32*b* of vertical rod or tube 32 by clamping receptacles 39 and 40. J-rod receptacles 41 and 42 are secured on belly plate 31 in slots 43 and 44 by screws or bolts or the like. J-rods 45 are secured in receptacles 41 and 42 by bolts 46. The upper, out-turned ends 34 and 35 of supporting rod or tube 33 are supported in clamping receptacles 47 and 48 on shoulder straps 36 and 37. A clamp 49 holds rods or tubes 32 and 33 in an articulated relation to permit angular flexing as shown in FIG. 4.

The materials of construction used in this carrier 30 are very important for achieving the desired result. The belly plate 31, supporting rods or tubes 32 and 33, shoulder straps 36 and 37 and back bar 38 are rigid and made of a light metal such as aluminum, magnesium or titanium. The metal shoulder straps have the advantage that different sizes are readily accommodated.

Operation

The operation of this carrier should be apparent but will be described briefly for clarity. The carrier 30 is worn by the musician with the shoulder straps 36 and 37 positioned over the shoulders and the belly plate 31 supported against the abdomen. J-rods 45 are inserted in position and secured in place by tightening bolts 46. The short outer ends of the J-rods 45 are inserted into the J-rod receptacles on the percussion instrument being carried, e.g., drums (single or array), cymbals, xylophone, marimba, or the like.

The carrier is adjustable to the comfort of the wearer and also to fit different sized instruments. Clamp-receptacles 47 and 48 permit pivotal, lateral and angular adjustment of shoulder straps 36 and 37 on the out-turned ends 34 and 35 of rod or tube 33. Clamp-receptacles 39 and 40 permit vertical sliding adjustment of rod or tube 32. Slots 43 and 44 in belly plate 31 allow lateral adjustment of clamp-receptacles 41 and 42 and angular adjustment of J-rods 45 supported therein.

Figure 5:
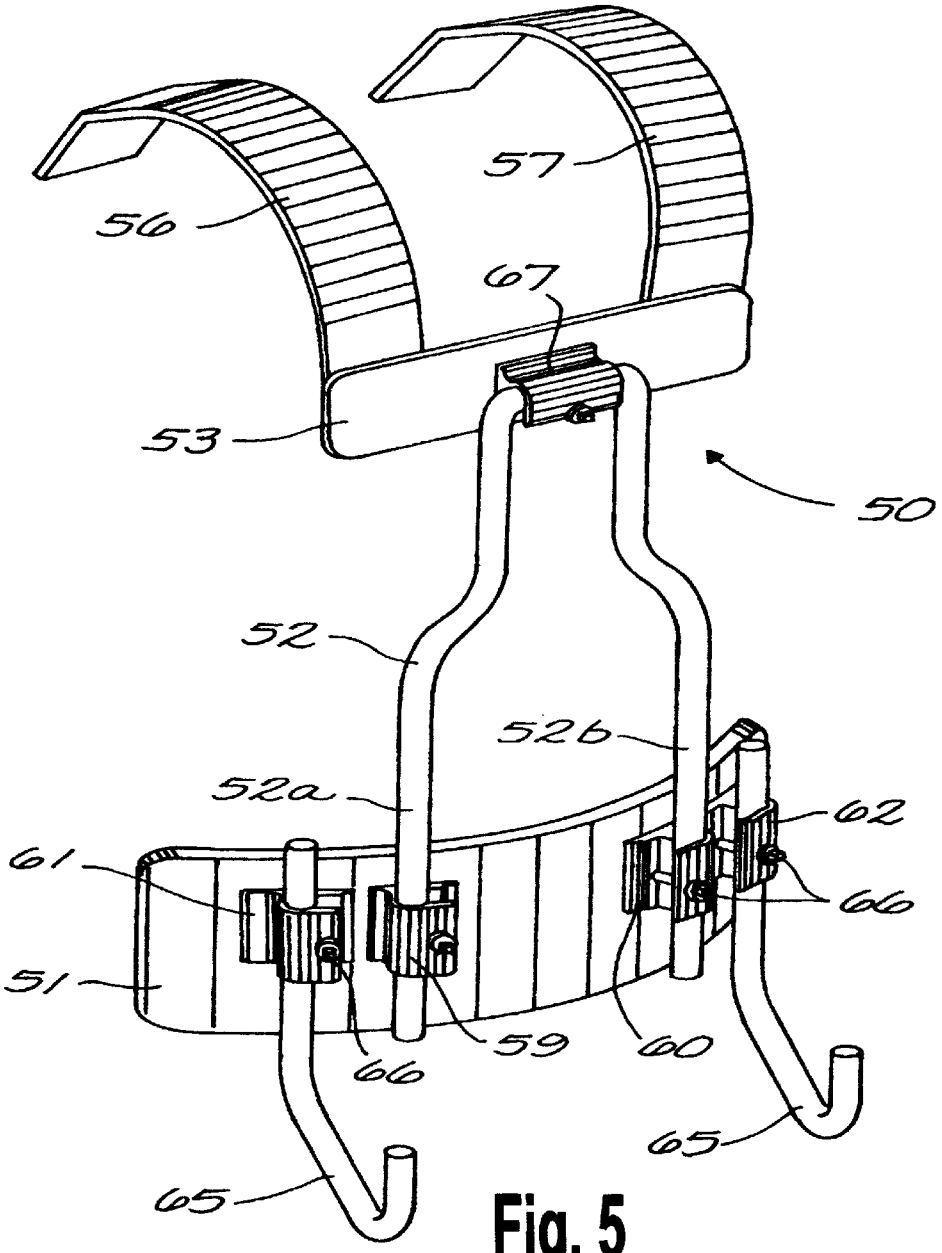
FIG. 5 is a front isometric view of an embodiment with the back bar removed.

Another Embodiment of Marching T-Bar Type Support for Drums and Other Percussion Instruments Referring to FIG. 5, there is shown a T-bar-type carrier 50 for percussion instruments which comprises a belly plate 51, an inverted U-shaped vertical supporting rod or tube 52. Rod or tube 52 has parallel portions 52*a* and 52*b* supporting belly plate 51. Rigid shoulder straps 56 and 57 are secured on bar 53.

Belly plate 51 is removably secured on the lower ends 52*a* and 52*b* of vertical rod or tube 52 by clamping receptacles 59 and 60. J-rod receptacles 61 and 62 are secured on belly plate 51. J-rods 65 are secured in receptacles 61 and 62 by bolts 66. The upper U-portion of supporting rod or tube 52 is supported in clamping receptacle 67 on bar 53 to support shoulder straps 56 and 57. The materials of construction used in this carrier 30 are very important for achieving the desired result. The belly plate 51, supporting rod or tube 52, and shoulder straps 56 and 57 are made of a light material such as plastic or a light metal such as aluminum, magnesium or titanium.

Operation

The operation of this carrier should be apparent but will be described briefly for clarity. The carrier 50 is worn by the musician with the shoulder straps 56 and 57 positioned over the shoulders and the belly plate 51 supported against the abdomen. J-rods 65 are inserted in position and secured in place by tightening bolts 66. The short outer ends of the J-rods 65 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacle 67 permits pivotal adjustment of shoulder straps 56 and 57. Clamp-receptacles 59 and 60 permit vertical sliding adjustment of rod or tube 52. Clamp-receptacles 61 and 62 permit angular adjustment of J-rods 65.

Figures 6, 7:
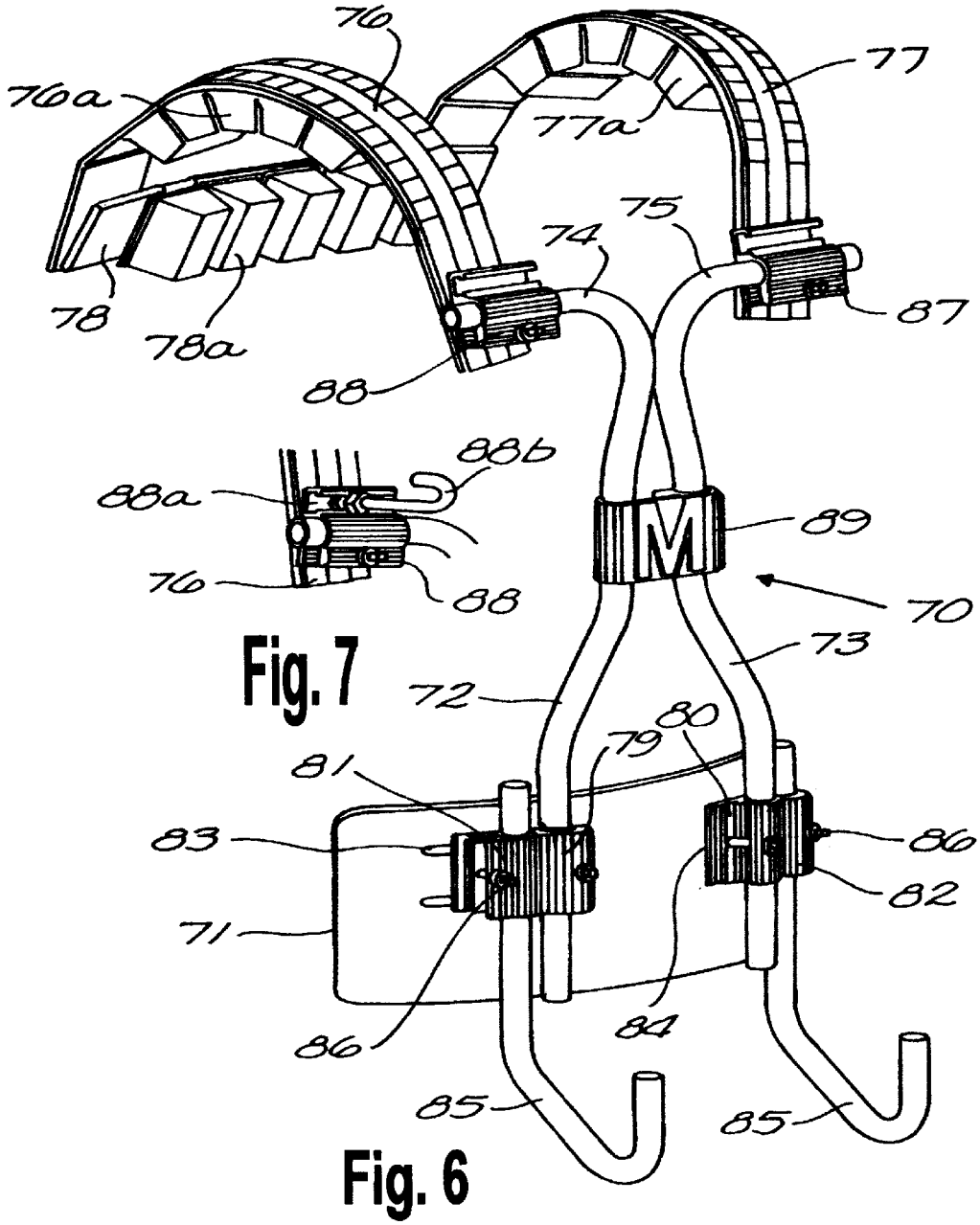
FIG. 6 is a front isometric view of supporting hardware with vertical and horizontal adjustability of the supports on the belly plate and adjustable shoulder straps and back bar.
FIG. 7 is a detail isometric view of connection of the shoulder straps of FIG. 6 with optional J-hooks for supporting a bass drum.

Another Embodiment of Marching T-Bar Type Support for Drums and Other Percussion Instruments Referring to FIGS. 6 and 7, there is shown a T-bar-type carrier 70 for percussion instruments which comprises a belly plate 71, vertical supporting rods or tubes 72 and 73 having out-turned portions 74 and 75 supporting rigid shoulder straps 76 and 77 and back bar 78. Back bar 78 may be removably secured to shoulder straps 78 or may be fixed as by welding or the like.

Belly plate 71 is removably secured on the lower ends of vertical rods or tubes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods or tubes 72 and 73 are supported in clamping receptacles 87 and 88 on shoulder straps 76 and 77. A clamp 89 holds rods or tubes 12 and 13 against lateral displacement.

Shoulder straps 76 and 77 and back bar 78 have cushions 76*a*, 77*a* and 78*a*, respectively. The cushions are of a type used to pad the interior of football and other sports helmets and are shown in more detail in copending application Ser. No. 08/976,999. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 88 may have a retaining slot 88*a* which receives and supports an optional J-hook 88*b* (FIG. 7) for connection to an upper part of a drum supported on carrier 70.

The materials of construction used in this carrier 70 are very important for achieving the desired result. The belly plate 71, vertical supporting rods or tubes 72 and 73, shoulder straps 76 and 77 and back bar 78 are rigid and made of a light material such as plastic or light metal such as aluminum, magnesium or titanium. The metal shoulder straps have the advantage that different sizes are readily accommodated.

Operation

The operation of this carrier should be apparent but will be described briefly for clarity. The carrier 70 is worn by the musician with the shoulder straps 76 and 77 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 87 and 88 permit pivotal, lateral and angular adjustment of shoulder straps 76 and 77 on the out-turned ends 74 and 75 of rods or tubes 72 and 73. Clamp-receptacles 79 and 80 permit vertical sliding adjustment of rods or tubes 72 and 73. Slots 83 and 84 in belly plate 71 allow lateral adjustment of clamp-receptacles 81 and 82 and angular adjustment of J-rods 85 supported therein.

Three additional embodiments of this carrier are shown in FIGS. 8–13.

Figure 8:
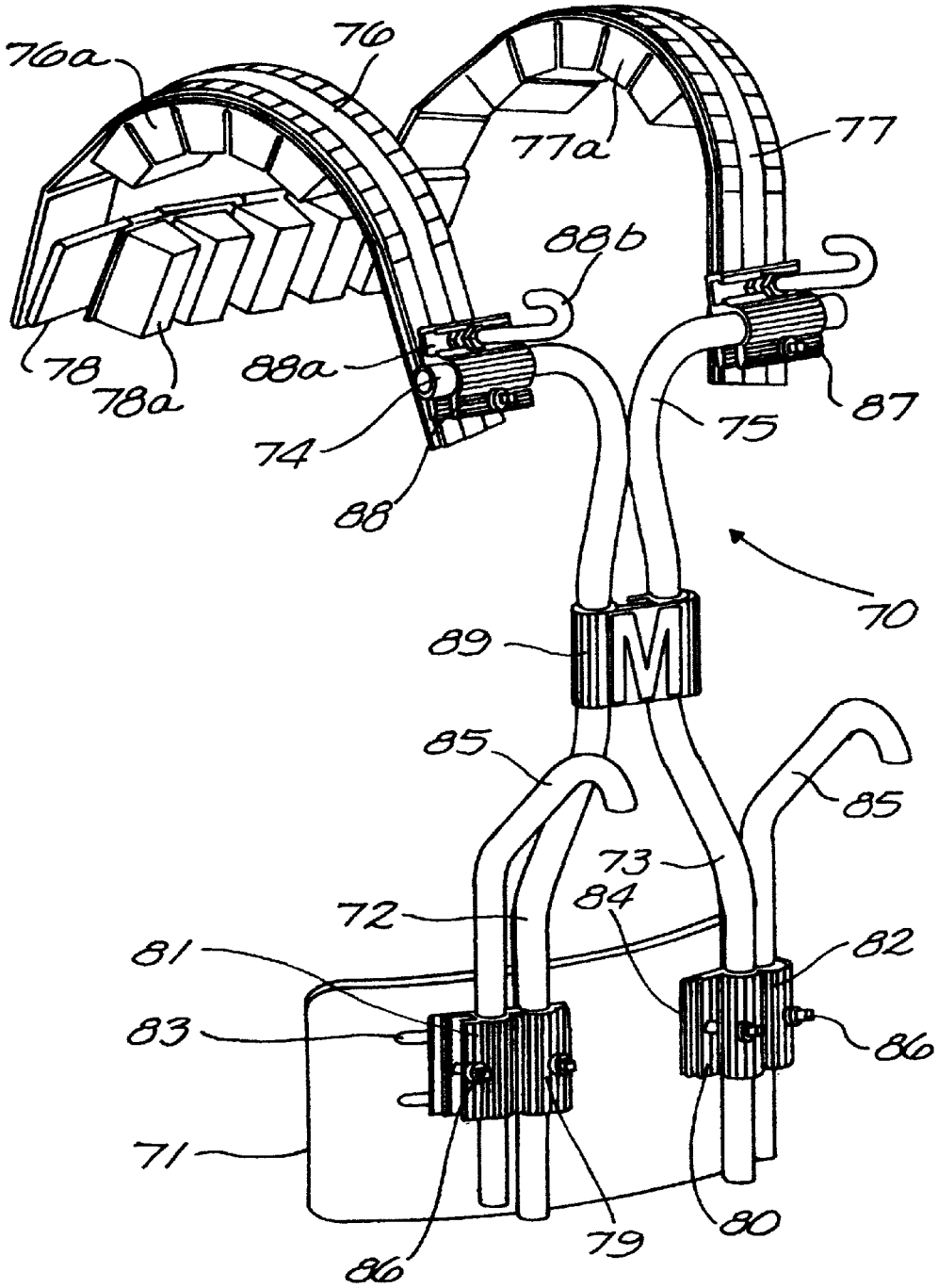
FIG. 8 is a front isometric view of the fully assembled carrier and supporting hardware of FIG. 6 with J-rods positioned in an inverted position for supporting the drum.

Another Embodiment of Marching T-Bar Type Support for Drums and Other Percussion Instruments Referring to FIG. 8, there is shown a T-bar-type carrier 70, as in FIGS. 6 and 7, for percussion instruments which comprises a belly plate 71, vertical supporting rods or tubes 72 and 73 having out-turned portions 74 and 75 supporting rigid shoulder straps 76 and 77 and back bar 78. Back bar 78 may be removably secured to shoulder straps 78 or may be fixed as by welding or the like.

Belly plate 71 is removably secured on the lower ends of vertical rods or tubes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods or tubes 72 and 73 are supported in clamping receptacles 87 and 88 on shoulder straps 76 and 77. J-hooks 88*b* are installed in slots 88*a* on receptacle/clamp 88 and the J-rods 85 are inverted for a different drum being supported thereon. A clamp 89 holds rods or tubes 12 and 13 against lateral displacement.

Shoulder straps 76 and 77 and back bar 78 have cushions 76*a*, 77*a* and 78*a*, respectively. The cushions are of a type used to pad the interior of football and other sports helmets and are shown in more detail in copending application Ser. No. 08/976,999. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 88 may have a retaining slot 88*a* which receives and supports an optional J-hook 88*b* (FIG. 7) for connection to an upper part of a drum supported on carrier 70.

The materials of construction used in this carrier 70 are very important for achieving the desired result. The belly plate 71, vertical supporting rods or tubes 72 and 73, shoulder straps 76 and 77 and back bar 78 are rigid and made of a light material such as plastic or a light metal such as aluminum, magnesium or titanium. The metal shoulder straps have the advantage that different sizes are readily accommodated.

Operation

The operation of this carrier should be apparent but will be described briefly for clarity. The carrier 70 is worn by the musician with the shoulder straps 76 and 77 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 87 and 88 permit pivotal, lateral and angular adjustment of shoulder straps 76 and 77 on the out-turned ends 74 and 75 of rods or tubes 72 and 73. Clamp-receptacles 79 and 80 permit vertical sliding adjustment of rods or tubes 72 and 73. Slots 83 and 84 in belly plate 71 allow lateral adjustment of clamp-receptacles 81 and 82 and angular adjustment of J-rods 85 supported therein.

Figure 9:
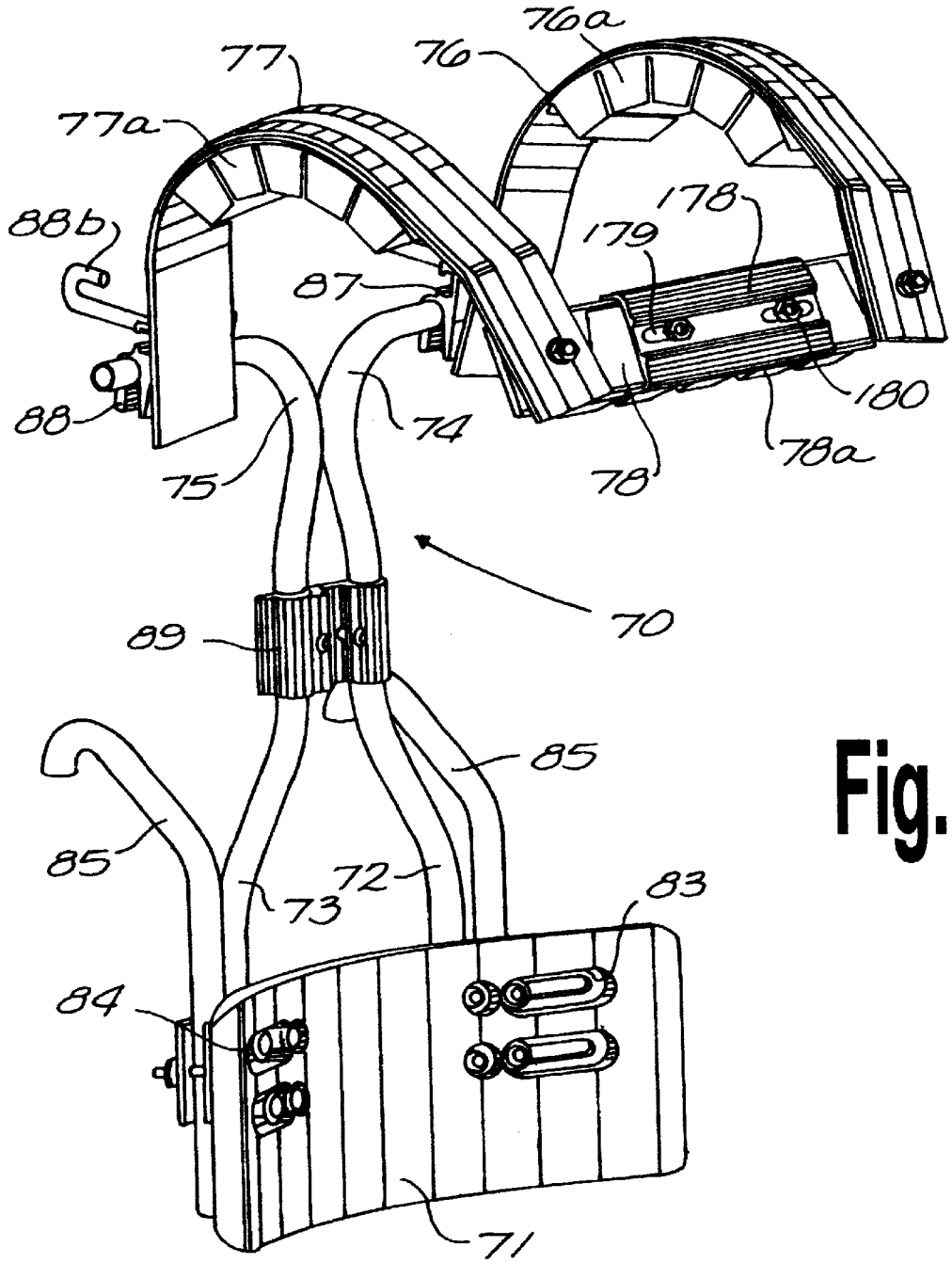
FIG. 9 is a rear isometric view of the embodiment of FIG. 8.

Another Embodiment of Marching T-Bar Type Support for Drums and Other Percussion Instruments Referring to FIG. 9, there is shown a T-bar-type carrier 70, as in FIG. 8, for percussion instruments which comprises a belly plate 71, vertical supporting rods or tubes 72 and 73 having out-turned portions 74 and 75 supporting rigid shoulder straps 76 and 77 and back bar 78. Back bar 78 may be removably secured to shoulder straps 78 or may be fixed as by welding or the like.

Belly plate 71 is removably secured on the lower ends of vertical rods or tubes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods or tubes 72 and 73 are supported in clamping receptacles 87 and 88 on shoulder straps 76 and 77. J-hooks 88*b* are installed in slots 88*a* on receptacle/clamp 88 and the J-rods 85 are inverted for a different drum being supported thereon. A clamp 89 holds rods or tubes 12 and 13 against lateral displacement.

Shoulder straps 76 and 77 and back bar 78 have cushions 76*a,* 77*a* and 78*a,* respectively. The cushions are of a type used to pad the interior of football and other sports helmets and are shown in more detail in copending application Ser. No. 08/976,999. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 88 may have a retaining slot 88*a* which receives and supports an optional J-hook 88*b* (FIG. 7) for connection to an upper part of a drum supported on carrier 70.

Back bar 78 has a two-piece slotted construction of the back bar which permits adjustment of the size thereof. The two pieces of back bar 78 are connected by connecting plate 178 having slots 179 and secured by bolts 180 for adjustment of its width.

The materials of construction used in this carrier 70 are very important for achieving the desired result. The belly plate 71, vertical supporting rods or tubes 72 and 73, shoulder straps 76 and 77 and back bar 78 are rigid and made of a light material such as plastic or a light metal such as aluminum, magnesium or titanium. The metal shoulder straps have the advantage that different sizes are readily accommodated.

Operation

The operation of this carrier should be apparent but will be described briefly for clarity. The carrier 70 is worn by the musician with the shoulder straps 76 and 77 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 87 and 88 permit pivotal, lateral and angular adjustment of shoulder straps 76 and 77 on the out-turned ends 74 and 75 of rods or tubes 72 and 73. Clamp-receptacles 79 and 80 permit vertical sliding adjustment of rods or tubes 72 and 73. Slots 83 and 84 in belly plate 71 allow lateral adjustment of clamp-receptacles 81 and 82 and angular adjustment of J-rods 85 supported therein.

Figure 10:
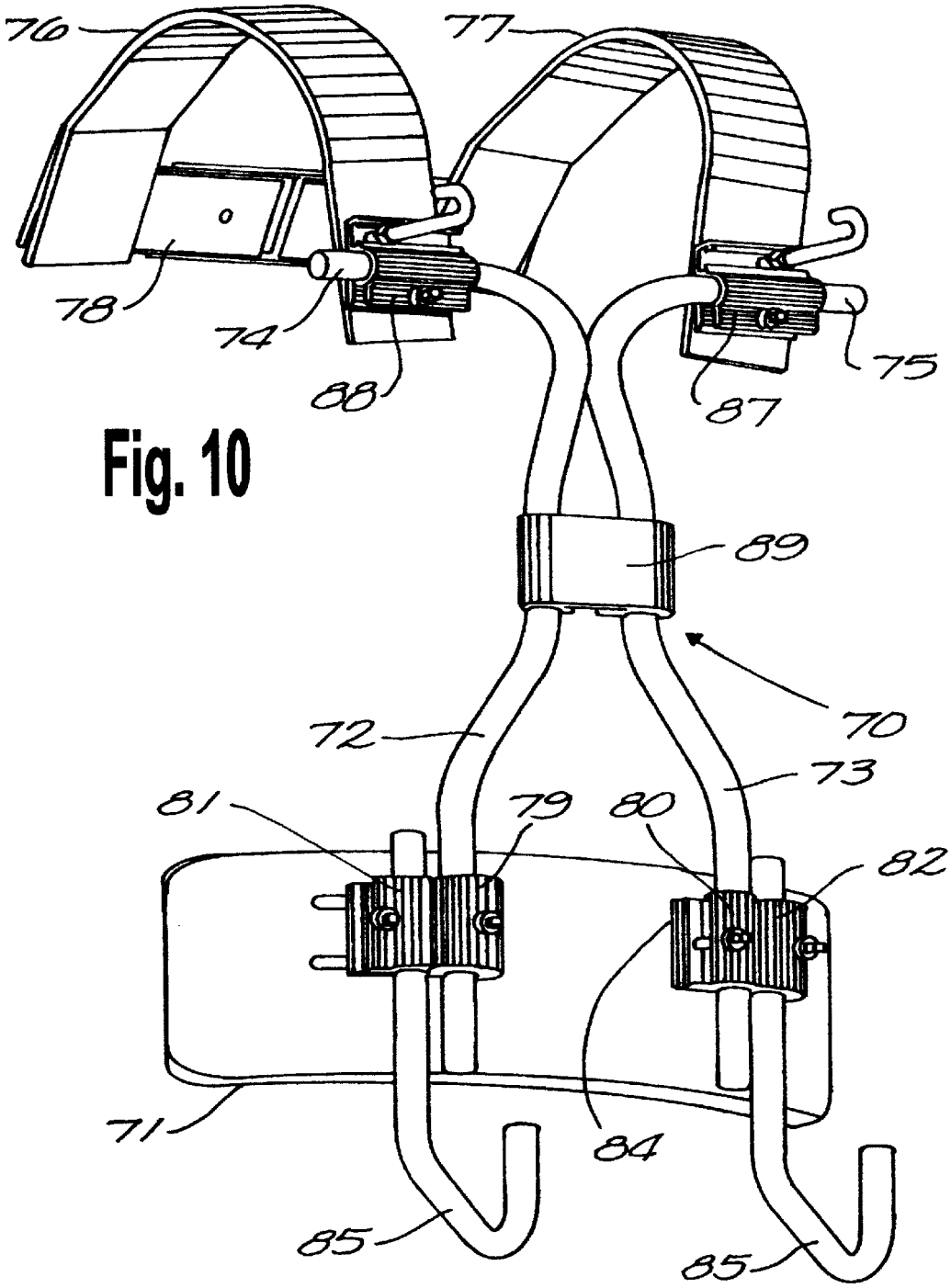
FIG. 10 is a front isometric view of the fully assembled carrier and supporting hardware of FIG. 8 with J-rods positioned in a normal position for supporting the drum.
Figure 11:
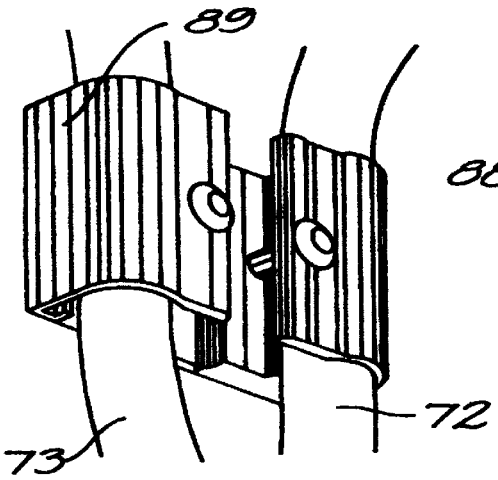
FIG. 11 is a detail isometric view of the clamp shown in FIG. 10 showing the connection of the vertical supporting rods and/or tubes.
Figure 12:
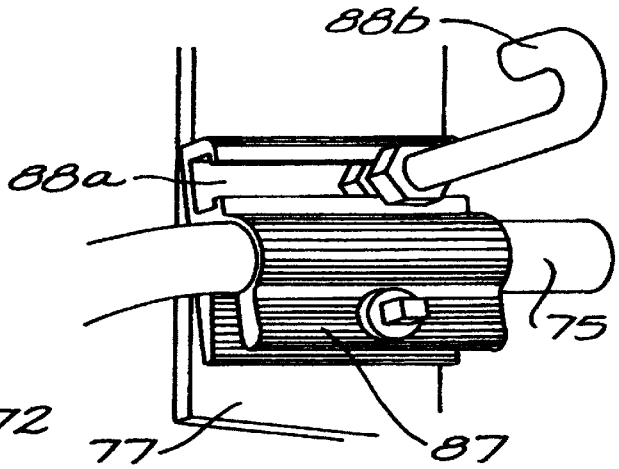
FIG. 12 is a detail isometric view of clamp for the shoulder straps shown in FIG. 10.
Figure 13:
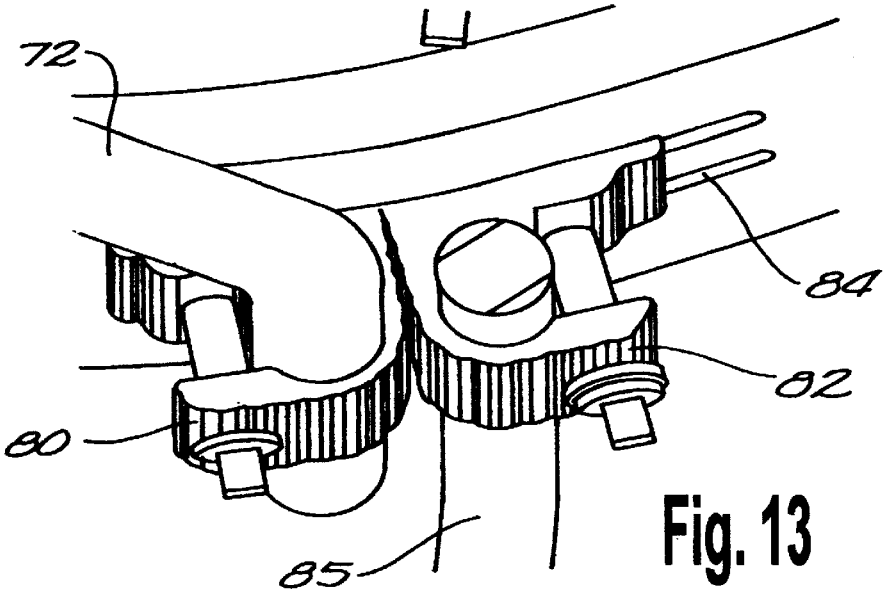
FIG. 13 is a detail isometric view of the adjustable supporting clamp on the belly plate of the drum-supporting hardware of FIG. 10.

FIG. 10 shows the embodiment of FIGS. 9 with the cushioning of the shoulder straps and back bar omitted. The back bar 78 adjustable as in FIG. 9.

Marching Vest-Type Support for Drums and Other Percussion Instruments

Figure 14:
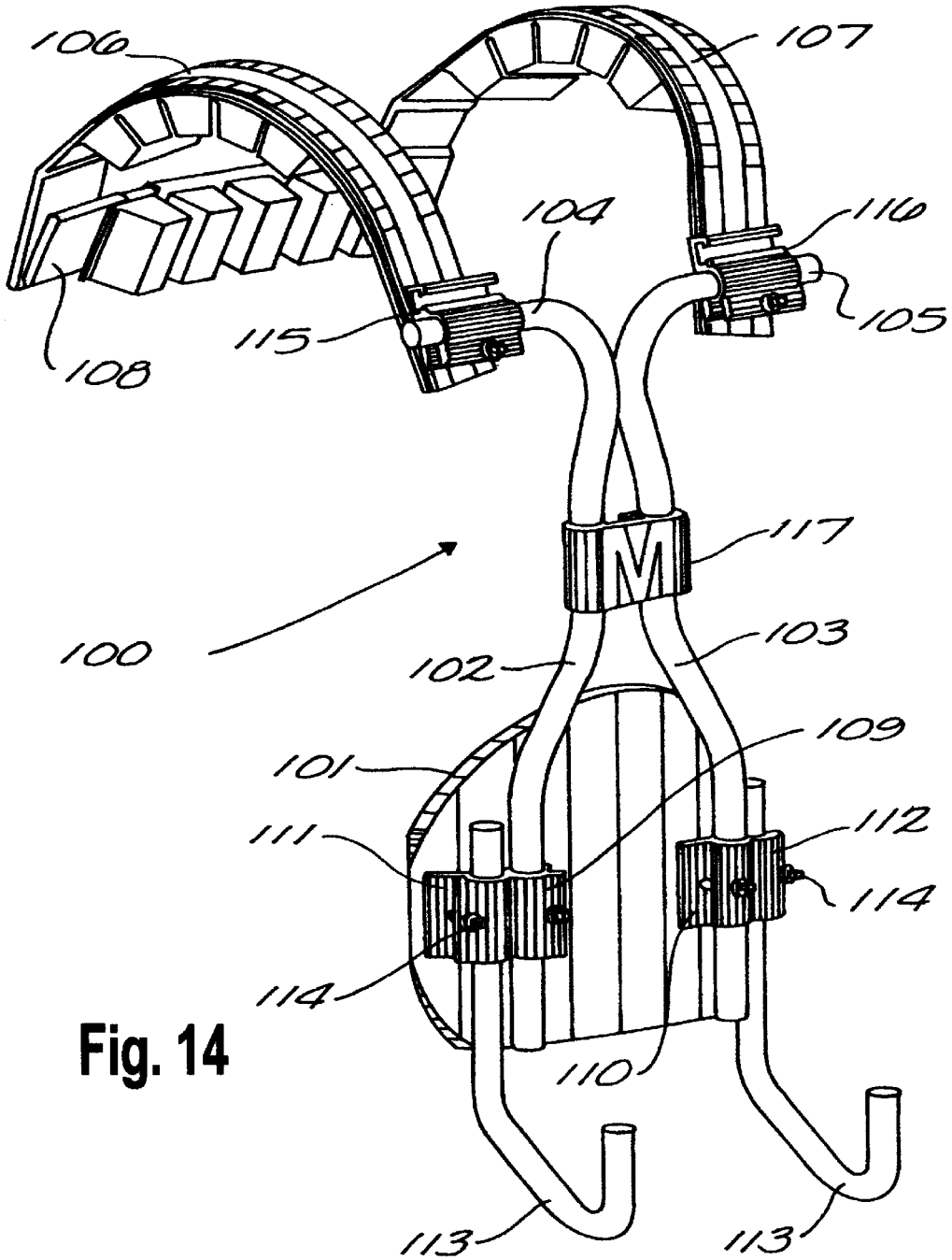
FIG. 14 is an isometric view of another embodiment of the invention shown in FIGS. 1 and 2 in which the abdominal belly plate is replaced by a vest-type support.

Referring to FIG. 14, there is shown a vest-type carrier 100 for percussion instruments which comprises a vest 101, vertical supporting rods or tubes 102 and 103 having out-turned portions 104 and 105 supporting rigid shoulder straps 106 and 107 and back bar 108. Back bar 108 may be removably secured to shoulder straps 106 and 107 or may be fixed as by welding or the like.

Vest 101 is removably secured on the lower ends of vertical rods or tubes 102 and 103 by clamping receptacles 109 and 110. J-rod receptacles 111 and 112 may be secured on vest plate 101 in slots by screws or bolts or the like. J-rods 113 are secured in receptacles 111 and 112 by bolts 114. The upper, out-turned ends 104 and 105 of supporting rods or tubes 102 and 103 are supported in clamping receptacles 115 and 116 on shoulder straps 106 and 107. A clamp 117 holds rods or tubes 102 and 103 against lateral displacement.

The materials of construction used in this carrier 100 are very important for achieving the desired result. The vest 101, vertical supporting rods or tubes 102 and 103, shoulder straps 106 and 107 and back bar 108 are rigid and made of a light material such as plastic or a light metal such as aluminum, magnesium or titanium. The metal shoulder straps have the advantage that different sizes are readily accommodated.

Operation

The operation of this carrier should be apparent but will be described briefly for clarity. The carrier 100 is worn by the musician with the shoulder straps 106 and 107 positioned over the shoulders and the vest 101 supported against the abdomen and chest. J-rods 113 are inserted in position and secured in place by tightening bolts 114. The short outer ends of the J-rods 113 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 115 and 116 permit pivotal, lateral and angular adjustment of shoulder straps 106 and 107 on the out-turned ends 104 and 105 of rods or tubes 102 and 103. Clamp-receptacles 109 and 110 permit vertical sliding adjustment of rods or tubes 102 and 103. Slots in vest 101 allow lateral adjustment of clamp-receptacles 111 and 112 and angular adjustment of J-rods 113 supported therein.

Figure 15:
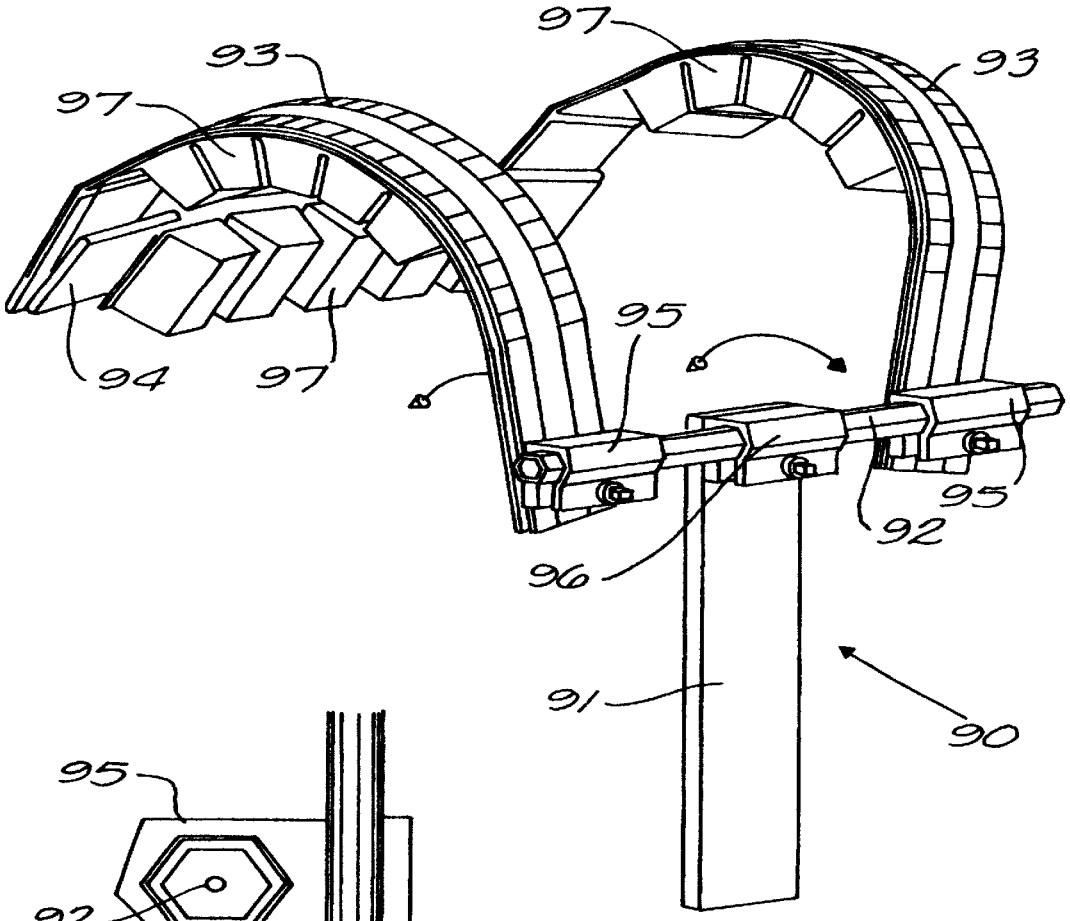
FIG. 15 is a detail isometric view of another embodiment of the shoulder strap connecting hardware.
Figure 16:
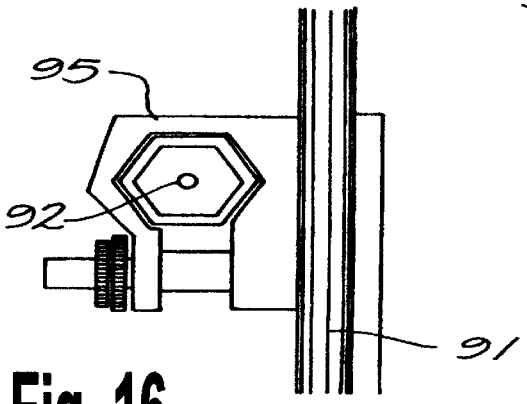
FIG. 16 is a detail end view of the shoulder strap connecting hardware of FIG. 15.
Figure 18:
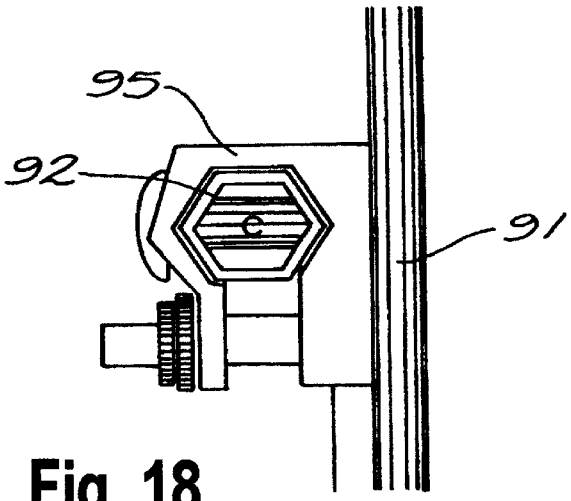
FIG. 18 is a detail end view of the shoulder strap connecting hardware of FIG. 17.

Another Embodiment of Marching T-Bar Type Support for Drums and Other Percussion Instruments Referring to FIGS. 15 and 16, there is shown the T-bar and shoulder straps of a T-bar-type carrier similar to that shown in FIG. 18 of copending application Ser. No. 08/976,999. T-bar carrier 90 has a belly plate (not shown); vertical bar 91, upper polygonal-shaped horizontal bar 92, shoulder straps 93 and back bar 94. Back bar 94 is either fixed to or removably secured to shoulder straps 93. Upper horizontal bar 92 is removably secured to shoulder straps 93 by clamps 95. Upper horizontal bar 92 is removably secured to the upper end of vertical bar 91 by clamp 96. Clamps 95 and 96 are polygon-ally shaped to fit the surface of bar 92 when tightened.

Shoulder straps 93 have pads 97 to cushion the load of the instruments carried by T-bar carrier 90. Pads 97 are also be used in padding back bar 94 as described for the other embodiments described above. The pads 97 are of a type used to pad the interior of football and other sports helmets.

Figure 17:
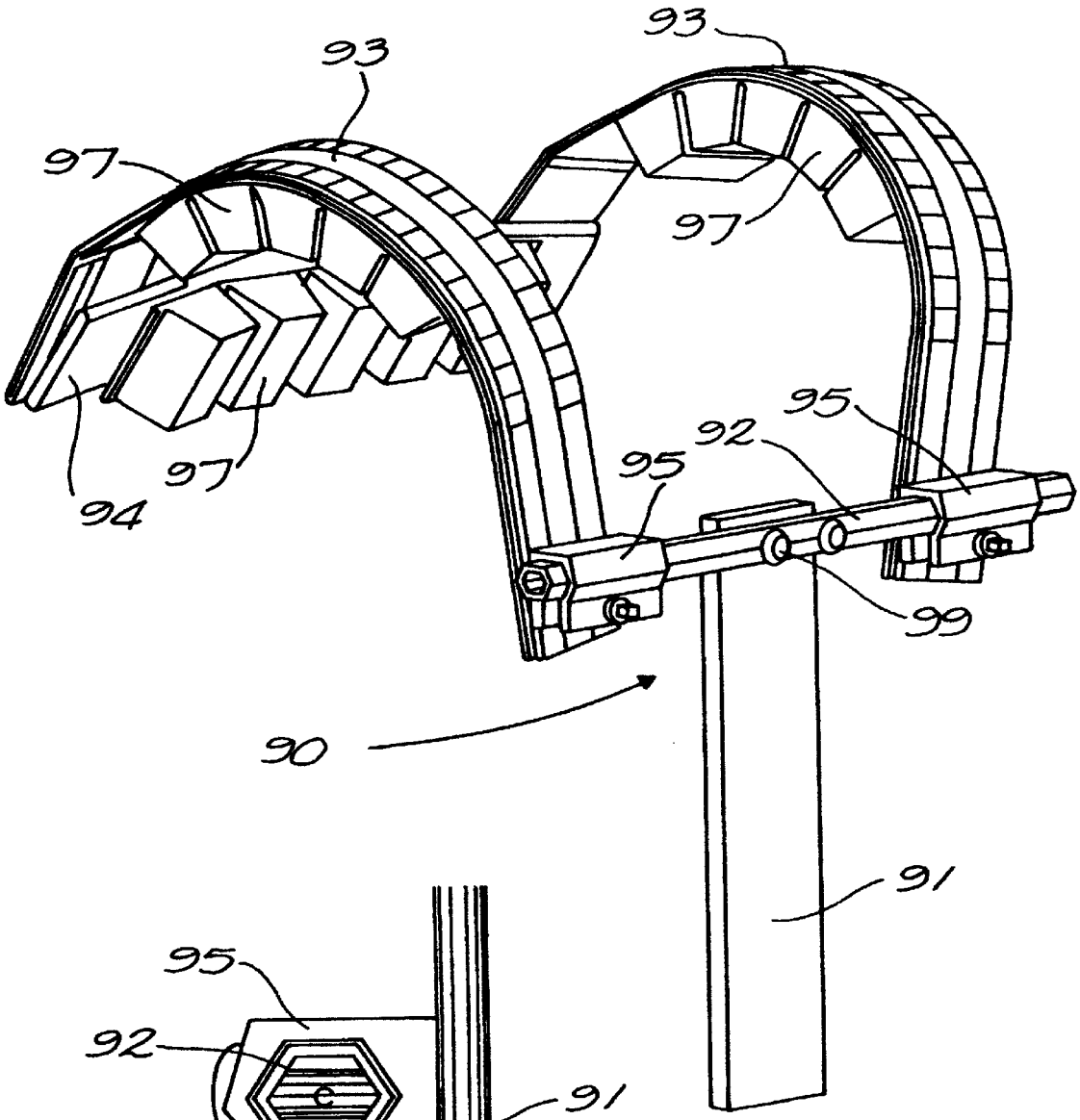
FIG. 17 is a detail isometric view of another embodiment of the shoulder strap connecting hardware having a fixed connection to the vertical supporting plate of a T-bar assembly.

In FIGS. 17 and 18, the carrier is constructed as in FIGS. 15 and 16, except that polygonal bar 62 is secured non-rotatably to vertical bar 91 by screws 99.

Operation

The operation of this carrier should be apparent but will be described briefly for clarity. The carrier 90 is worn by the musician with the shoulder straps 93 positioned over the shoulders and the belly plate (not shown) supported against his abdomen. Pads 97 on shoulder straps 93 cushion the load of the instruments carried by carrier 90. Clamps 95 permit lateral adjustment of shoulder straps 93 and clamp 96 permits angular adjustment of bar 92 in the embodiment of FIG. 14.

While this invention has been described fully and completely, with special emphasis on several preferred embodiments and/or applications, it should be understood that within the scope of the appended claims, the invention may be practiced otherwise than as specifically described.

What is claimed is:

1. A shoulder supported harness assembly for supporting percussion instruments, comprising a supporting member positioned to rest against the abdominal region of the wearer in use, a pair of rigid shoulder straps supporting said supporting member, receptacles secured on said supporting member, and drum supporting hardware operatively supported on said supporting member comprising rods or tubes supported in said receptacles and supported on said shoulder straps, and a back bar adjustably and removably supported between the ends of said shoulder straps.

2. A shoulder supported harness assembly for supporting percussion instruments according to claim 1, in which:

the rod or tube supported in said receptacles is a J-rod for supporting cymbals or other percussion hardware.

3. A shoulder supported harness assembly for supporting percussion instruments, comprising:

a supporting member resting against the abdominal region of the wearer in use, a pair of rigid shoulder straps for supporting said supporting member, a plurality of clamping receptacles supported on said supporting member and on said shoulder straps, supporting tubes or rods connected in said clamping receptacles on said shoulder straps and said supporting member for adjustment and/or removal, and drum supporting hardware on said supporting member.

4. A shoulder supported harness assembly for supporting percussion instruments according to claim 3, including:

a back bar secured between said shoulder straps for contacting the back of the wearer.

5. A shoulder supported harness assembly for supporting percussion instruments according to claim 4, in which:

said back bar is removable.

6. A shoulder supported harness assembly for supporting percussion instruments according to claim 3, in which:

said clamping receptacles on said shoulder straps are positioned laterally on the ends of the shoulder straps, said clamping receptacles on said supporting member are positioned vertically thereon, said tubes or rods having ends fitting in said shoulder strap clamping receptacles and in said supporting member clamping receptacles permitting adjustment of pivotal, angular, or lateral position on said shoulder straps and vertical position on said supporting member.

7. A shoulder supported harness assembly for supporting percussion instruments according to claim 3, in which:

said supporting member is a belly plate, said clamping receptacles on said shoulder straps are positioned laterally on the ends of the straps, said clamping receptacles on said belly plate are positioned vertically thereon, said tubes or rods having outturned ends fitting in each of said shoulder strap clamping receptacles permitting adjustment of pivotal, angular, or lateral position on said shoulder straps and other ends fitting in each of said belly plate clamping receptacles permitting vertical positioning on said belly plate.

8. A shoulder supported harness assembly for supporting percussion instruments according to claim 7, in which:

said shoulder strap clamping receptacles have anchoring slots thereon, and

J-hook members supported in said anchoring slots.

9. A shoulder supported harness assembly for supporting percussion instruments according to claim 3, in which:

said supporting member is a belly plate, said clamping receptacles on said shoulder straps are positioned laterally of the ends of the straps, said clamping receptacles on said belly plate are positioned vertically thereon, one of said tubes or rods being of a U-shape and having outturned ends fitting in each of said shoulder strap clamping receptacles permitting adjustment of pivotal, angular, or lateral position on said shoulder straps, another of said tubes or rods being of a U-shape having spaced ends fitting in each of said belly plate clamping receptacles permitting vertical positioning on said belly plate, and a clamp member securing said U-shaped tubes or rods together in a fixed but pivotally adjustable relation.

10. A shoulder supported harness assembly for supporting percussion instruments according to claim 9, in which:

said shoulder strap clamping receptacles have anchoring slots thereon, and

J-hook members supported in said anchoring slots.

11. A shoulder supported harness assembly for supporting percussion instruments according to claim 3, including:

a bar member connecting said shoulder straps, said clamping receptacles for said shoulder straps being positioned on said bar member laterally of the ends of the shoulder straps, said supporting member which is a belly plate, said clamping receptacles on said belly plate which are positioned vertically thereon, one of said tubes or rods being U-shaped and fitting in one of said shoulder strap clamping receptacles and having spaced ends fitting in said belly plate clamping receptacles permitting adjustment of position on said shoulder straps and on said belly plate.

12. A shoulder supported harness assembly for supporting percussion instruments according to claim 3, in which:

said supporting member is a vest of light rigid material, said clamping receptacles on said shoulder straps are positioned laterally of the ends of the straps, said clamping receptacles on said vest are positioned vertically thereon, and said tubes or rods have outturned ends fitting in each of said shoulder strap clamping receptacles permitting adjustment of pivotal, angular, or lateral position on said shoulder straps and other ends fitting each of said vest clamping receptacles permitting vertical positioning thereon.

13. A shoulder supported harness assembly for supporting percussion instruments according to claim 3, in which:

said supporting member is a vest of light rigid material, said clamping receptacles on said shoulder straps are positioned laterally of the ends of the straps, said clamping receptacles on said vest are positioned vertically thereon, one of said tubes or rods is of a U-shape and has outturned ends fitting each of said shoulder strap clamping receptacles permitting adjustment of pivotal, angular, or lateral position on said shoulder straps, another of said tubes or rods is of a U-shape having spaced ends fitting in each of said vest clamping receptacles permitting vertical positioning on said vest, and a clamp member securing said U-shaped tubes or rods together in a fixed but pivotally adjustable relation.

14. A shoulder supported harness assembly for supporting percussion instruments according to claim 3, including:

a bar member connecting said shoulder straps, said clamping receptacle for said shoulder straps being positioned on said bar member laterally of the ends of the straps, said supporting member which is a vest of light rigid material, said clamping receptacles on said vest are positioned vertically thereon, and one of said tubes or rods being U-shaped fitting said shoulder strap clamping receptacle and having spaced ends fitting said vest clamping receptacles permitting adjustment of position on said shoulder straps and on said vest.

15. A shoulder supported harness assembly for supporting percussion instruments, comprising:

a supporting member resting against the abdominal region of the wearer in use, a pair of rigid shoulder straps for supporting said supporting member, supporting tubes or rods connected on said shoulder straps and said supporting member for adjustment or removal, and drum supporting hardware on said supporting member.

16. A shoulder supported harness assembly for supporting percussion instruments, comprising:

a supporting member resting against the abdominal region of the wearer in use, a pair of rigid shoulder straps for supporting said supporting member, clamping receptacles supported on said supporting member and said shoulder straps, supporting tubes or rods connected in said clamping receptacles on said shoulder straps and said supporting member for adjustment or removal, and J-rods supported in clamping receptacles on said supporting member.

17. A shoulder supported harness subassembly for supporting percussion instruments, comprising a pair of rigid shoulder straps for supporting an instrument-supporting member, a horizontally oriented bar member secured between the ends of said shoulder straps, a plurality of clamping receptacles supported on said bar member, a vertically oriented supporting bar secured to one of said receptacles and supporting said bar member, others of said receptacles supporting said shoulder straps, and selected ones of said clamping receptacles being adjustable to permit angular or pivotal adjustment of said shoulder straps relative to said vertical supporting bar.

18. A shoulder supported harness assembly for supporting percussion instruments according to claim 17, in which:

said bar member has a polygonal cross section, and said clamping receptacles have of the same polygonal cross section as said bar member.

* * * * *